US011686560B2

(12) United States Patent
Taheri et al.

(10) Patent No.: US 11,686,560 B2
(45) Date of Patent: Jun. 27, 2023

(54) LIGHT SHIELD DEVICE

(71) Applicant: IMMOBILEYES, INC., Kent, OH (US)

(72) Inventors: Bahman Taheri, Shaker Heights, OH (US); Antonio Munoz, Shaker Heights, OH (US)

(73) Assignee: IMMOBILEYES INC., Kent, OH (US)

( * ) Notice: Subject to any disclaimer, the term of this patent is extended or adjusted under 35 U.S.C. 154(b) by 144 days.

(21) Appl. No.: 17/049,693

(22) PCT Filed: May 20, 2019

(86) PCT No.: PCT/US2019/033056
§ 371 (c)(1),
(2) Date: Oct. 22, 2020

(87) PCT Pub. No.: WO2019/222723
PCT Pub. Date: Nov. 21, 2019

(65) Prior Publication Data

US 2021/0239437 A1 Aug. 5, 2021

Related U.S. Application Data

(60) Provisional application No. 62/673,442, filed on May 18, 2018.

(51) Int. Cl.
*F41H 13/00* (2006.01)
*F41A 33/02* (2006.01)

(52) U.S. Cl.
CPC ..... *F41H 13/0087* (2013.01); *F41A 33/02* (2013.01); *F41H 13/0056* (2013.01)

(58) Field of Classification Search
None
See application file for complete search history.

(56) References Cited

U.S. PATENT DOCUMENTS 5,612,503 A 3/1997 Sepp
5,973,309 A 10/1999 Livingston
(Continued)

FOREIGN PATENT DOCUMENTS

WO 2010085652 A2 7/2010

OTHER PUBLICATIONS

International Search Report dated Aug. 6, 2019 in related application No. PCT/US2019/033056.
(Continued)

*Primary Examiner* — Reginald S Tillman, Jr.
(74) *Attorney, Agent, or Firm* — Atossa Alavi

(57) ABSTRACT

A visual impairment device includes a power supply, an intense light source having two or more beams of intense light with different peak wavelengths and a wavelength bandwidth less than 50 nm, a modulator and a control circuit. The modulator operates to modulates the two or more beams of intense light to produce a spatial array such that at least one of the beams used to produce the spatial array has the requisite irradiance to cause visual impairment. In some examples, the beams of intense light are laser beams. Also included are methods of using the device to cause visual impairment of an intruder who enters a visual impairment zone created by said device.

21 Claims, 6 Drawing Sheets

(56) References Cited

U.S. PATENT DOCUMENTS

| | | | | |
|---|---|---|---|---|
| 5,982,553 | A * | 11/1999 | Bloom | G02B 26/10 359/627 |
| 6,142,650 | A * | 11/2000 | Brown | F41H 13/0056 353/43 |
| 6,147,789 | A | 11/2000 | Gelbart | 359/231 |
| 6,190,022 | B1 | 2/2001 | Tocci et al. | 362/259 |
| 7,483,454 | B2 | 1/2009 | Hauck et al. | |
| 7,827,726 | B2 * | 11/2010 | Stokes | F41G 1/35 42/146 |
| 8,051,761 | B1 | 11/2011 | Ullman et al. | |
| 8,113,660 | B1 | 2/2012 | Troyer | |
| 8,434,920 | B2 | 5/2013 | Jones | |
| 8,908,277 | B2 | 12/2014 | Pesach et al. | |
| 8,908,731 | B1 | 12/2014 | Raring et al. | F41H 13/0056 |
| 9,857,149 | B2 | 1/2018 | Rubtsov et al. | |
| 10,495,422 | B2 | 12/2019 | Palti | |
| 10,567,106 | B2 | 2/2020 | Thum-Jaeger et al. | |
| 10,712,131 | B2 | 7/2020 | Poplawski | |
| 2006/0234191 | A1 | 10/2006 | Ludman | |
| 2007/0274353 | A1 | 11/2007 | Hauck et al. | 372/9 |
| 2012/0075843 | A1 | 3/2012 | Battis et al. | 362/157 |
| 2015/0378242 | A1 | 12/2015 | Auxier et al. | |
| 2018/0341262 | A1 | 11/2018 | Yeshurun | |

OTHER PUBLICATIONS

Written Opinion dated Aug. 6, 2019 in related application No. PCT/US2019/033056.

Demik et al.; *Measuring Intensity of Laser Light Penetrating Flight Decks in Laser Illuminations*; Journal of Aviation Technology and Engineering; 3:1 (2013) 9-16.

Donne et al.; *Multi-wavelength Optical Dazzler for Personnel and Sensor Incapacitation*; Proc. of SPIE vol. 6219, 621902 (2006).

Schlmeister et al.; *The risk of retinal injury from Class 2 and visible Class3R lasers, including medical laser aiming beams*; Medical Laser Application; 25 (2010); 99-110.

Toet et al.; *Optical countermeasures against CLOS weapon systems*; Technologies for Optical Countermeasures X; and High-Power Lasers 2013; Technology and Systems; Proc. of SPIE vol. 8898; 2013.

Upton et al.; *Smart, white-light dazzler*; Sensors, and Command, Control, Communications, and Intelligence (C3I) Technologies for Homeland Security and Homeland Defense III; E.M. Carapezza, ed. Proc; SPIE vol. 5403 (SPIE, Bellingham, WA; 2004).

Jahns et al., Dammann gratings for laser beam shaping, Optical Engineering, Dec. 1989, vol. 28 No. 12, p. 1267.

Katz et al., Using Diffractive Optical Elements, Laser Technik Journal, Apr. 2018, p. 29.

Williamson et al., Nominal ocular dazzle distance (NODD), Applied Optics, vol. 54, No. 7; Mar. 1, 2015, p. 1564.

Williamson et al., Determination of a laser eye dazzle safety framework, Journal of Laser Applications, vol. 30, No. 3, Aug. 2018.

Hode, What lasers can make you blind, Swedish Laser—Medical Society.

* cited by examiner

LIGHT SHIELD DEVICE

CROSS-REFERENCE TO RELATED APPLICATION

This application is a § 371 application of International patent application number PCT/US2019/033056 filed May 20, 2019, which claims the benefit of U.S. provisional patent application Ser. No. 62/673,442 filed on May 18, 2018.

TECHNICAL FIELD

The following invention relates to visual impairment devices to distract and/or to deter intruders, active shooters and other potential threats.

BACKGROUND ART

In the current environment of rising school shootings, effective safety measures are a necessity. However, many school and university buildings are constructed to achieve an inviting and open campus style, with multiple buildings, multiple entrances and exits, and big windows. Unfortunately, these design configurations are not conducive to security and lockdown. One security solution is to immobilize or disable a potential shooter or intruder at an entrance or other location for a period of time, long enough for law enforcement to respond to the situation.

A well known phenomenon in aviation is laser-induced vision impairment. High power LEDs and lasers are highly flexible bright light sources that are particularly suited to interfere with human vision, because they are: 1) inexpensive and readily available, 2) non-lethal, 3) can be adjusted to cause only temporary incapacitation (e.g. glare, flash-blindness or dazzle) without causing permanent injury and 4) can be exceedingly hard to protect against. These LEDs and lasers can easily be varied in intensity, color (wavelength), size, modulation, frequency etc. and as such are very versatile.

For instance, laser-induced visual disturbance, temporal blindness and eye damage is a well-known and major problem for airline pilots who are attacked by bystanders with laser pointers. Hand held laser pointer attacks against pilots are difficult to stop because the perpetrator can be located at a long distance from the target point. These devices cause temporary blindness of the pilot after just one exposure. Therefore, an attacker can effectively impair a pilot's vision by simply pointing a laser at a pilot who is seated in a cockpit.

In the military, laser light dazzlers are known and have been used offensively to disable enemy combatants. See, e.g. U.S. Pat. No. 7,483,454. These devices, however, are complicated to design, build and use because they all require components that enable a user to precisely point a single beam towards a target's eyes, They also require a projection system that will collimate and direct the beam, with precise controls in order to alter the divergence of the beam depending on the distance from the target, etc. See e.g. Donne at at (2006), Multi-wavelength Optical Dazzler for Personnel and Sensor Incapacitation, Proc. of SPIE Vol. 6219, 621902 (2006); and Upton et at (2004) Smart, white-light dazzler, in Sensors, and Command, Control, Communications, and Intelligence (C3I) Technologies for Homeland Security and Homeland Defense III, E. M. Carapezza, ed. Proc. Of SPIE Vol. 5403 (SPIE, Bellingham, Wash. 2004). Because of their need for accuracy in the exact location of the target, these devices cannot effectively disable an intruder whose exact eye location is unknown.

In the real world, the problem is that it is not always possible to know the exact position of an intruder's eye, and it is difficult to precisely point a laser "gun" at a moving intruder. Rather, the laser device needs to create a "No-Go" zone to deter a person from entering an area, or to disorient and distract a person that enters that area, without the need to point at a particular target's eye. None of the previously described devices work in this manner and as such, are ineffective for both of the above goals. Thus, there remains a need for a device that is easy to operate and that can cover an area to deter the entry of one or more intruders into that area.

Here, we describe a device that can produce a spatial and/or temporal distribution of one or more beams of intense light at two or more wavelengths capable of causing temporary visual impairment when hitting the eye of a person, such as an intruder or potential active shooter. Such a device can be used in many environments to prevent entry, or to disable a person who has already entered the area (e.g. an area in school hallways, doorways or classrooms, etc.). The device does not require significant training or proximity or direct engagement with the intruder, is non-lethal (and therefore preferable to a firearm) and can be used to disable a person for a period of time until an appropriate response is mounted.

SUMMARY OF THE INVENTION

We describe here a visual impairment device having: a power supply, an intense light source including two or more beams of intense light having different peak wavelengths and a wavelength bandwidth less than 50 nm, a modulator for modulating the two or more beams of intense light to produce a spatial array such that at least one of the beams used to produce the spatial array has the requisite irradiance to cause visual impairment. The device further has a control circuit.

The visual impairment caused by the device is chosen from one of: startle, distraction, glare, flash blindness, afterimage, photosensitivity, thermal or hemorrhagic lesion, eye damage, vertigo, disorientation, photophobia, headaches, muscle spasms, convulsions, epileptic seizures, or a combination thereof. In some examples, the beam with the requisite irradiance to cause visual impairment causes visual impairment within 250 msec (0.25 sec) of light exposure, i.e. the time it takes to blink.

In some embodiments, each beam peak wavelength is separated from each other beam peak wavelength by more than one wavelength band width.

In some embodiments, one of the beams of intense light has a wavelength that is outside the visible range of 400-700 nm. For example, the two intense light beams can be selected from: an ultraviolet light having a peak wavelength range 310-400 nm, a blue light having a peak wavelength range 400-500 nm, a green light having a peak wavelength range of 500-580 nm, a red light having a peak wavelength range 580-700 nm, or an infrared light having a peak wavelength range 700-1500 nm.

The intense light source can be chosen to produce an LED light, a pulsed laser, a continuous wave laser, or a combination thereof. In some examples, one or more of the beams of intense light is a laser beam. In some examples, one or more of the beams of intense light is a light emitting diode (LED).

The modulator can use various mechanisms, including a reflective light valve or a refractive light valve, or a combination thereof, for modulating the beams. The modulator can modulate the beams of intense light by one or more of the following ways: (a) by splitting a beam of intense light into multiple beams to achieve a static array or a moving array, or a combination thereof (b) by rasterring a beam of intense light to achieve a dynamic array; (c) by combining two or more beams of intense light to produce a colinearly propagating light beam to produce a static or a dynamic array; (d) or by any combination of the above. So, in some examples, the modulator includes an element selected from: a multiplexer, a beam steerer (rasterring), a mirror, a prism, a diffraction grating beam splitters or a combination thereof.

In some examples, the beams used to produce the spatial array are colinearly proparated.

The device can be designed to be controlled manually, automatically, remotely or by a combination thereof. In some examples, the device control circuit can adjust one or more parameters selected from: (a) divergence of the beams of intense light; (b) irradiance of the beams of intense light; (c) choice of wavelength for one or more of the beams of intense light; (d) the size of the spatial array; (e) the frequency of a dynamic spatial array; (f) the pattern of the spatial array; or (g) the frequency of modulation of a beam.

Also contemplated herein is a visual impairment device including: a power supply; a laser light source capable of producing two or more laser beams having different peak wavelengths, wherein at least one of said laser beams has a wavelength in the visible range of 400-700 run; a modulator for spatially modulating the two or more beams of intense light in a spatial array such that at least one of said beams in the array has the irradiance to cause visual impairment within 0.25 seconds of light exposure; and a control circuit.

In certain embodiments, the visual impairment device is hand-held.

Also contemplated here is a method of using any version of the device described above to cause visual impairment of a person who enters a visual impairment zone created by said device.

In some examples, the method includes creating a visual impairment zone by covering an area with the spatial array of intense light such that at least one of the beams used to produce the spatial array has the requisite irradiance to cause visual impairment within 0.25 seconds of exposure to said beam.

DETAILED DESCRIPTION OF THE INVENTION

Herein is described a visual impairment device having a light source of two or more beams of intense light, and a modulator for modulating the beams of light to produce a spatial array such that at least one of the beams used to produce the spatial array has the requisite irradiance to cause visual impairment when hitting the eye of a person (e.g. a potential active shooter, intruder, etc). The device operates to illuminate and create a "No-Go" or "visual impairment" zone without the need to track, pin-point or target a person's eyes. Rather, a person entering the visual impairment zone will be visually impaired because it will be difficult to avoid the intense light beams unless the person drops their gaze, or averts his eyes away from the incoming light in the spatial array. Thus, such a device does not have any component or means for tracking or targeting a single person. There is no need to have an accurate aiming control unit or means for measuring range or distance of target persons themselves.

The device, as contemplated, includes one or more light sources that are modulated to "cover" an area with a pattern of light beams, referred to herein as a spatial array of light. The modulation of the beams of light can occur either temporally or spatially. For example, one or more beams of light can be spatially modulated to produce a predetermined pattern of light beams or "spots" to produce a spatial array. Alternatively, or in addition, a modulator can cause a spatial array by temporally modulating light by moving one or more beams of light across a space in a predetermined pattern using, for example, a light steering or scanning mechanism such as a rasterring system.

Figure 1:
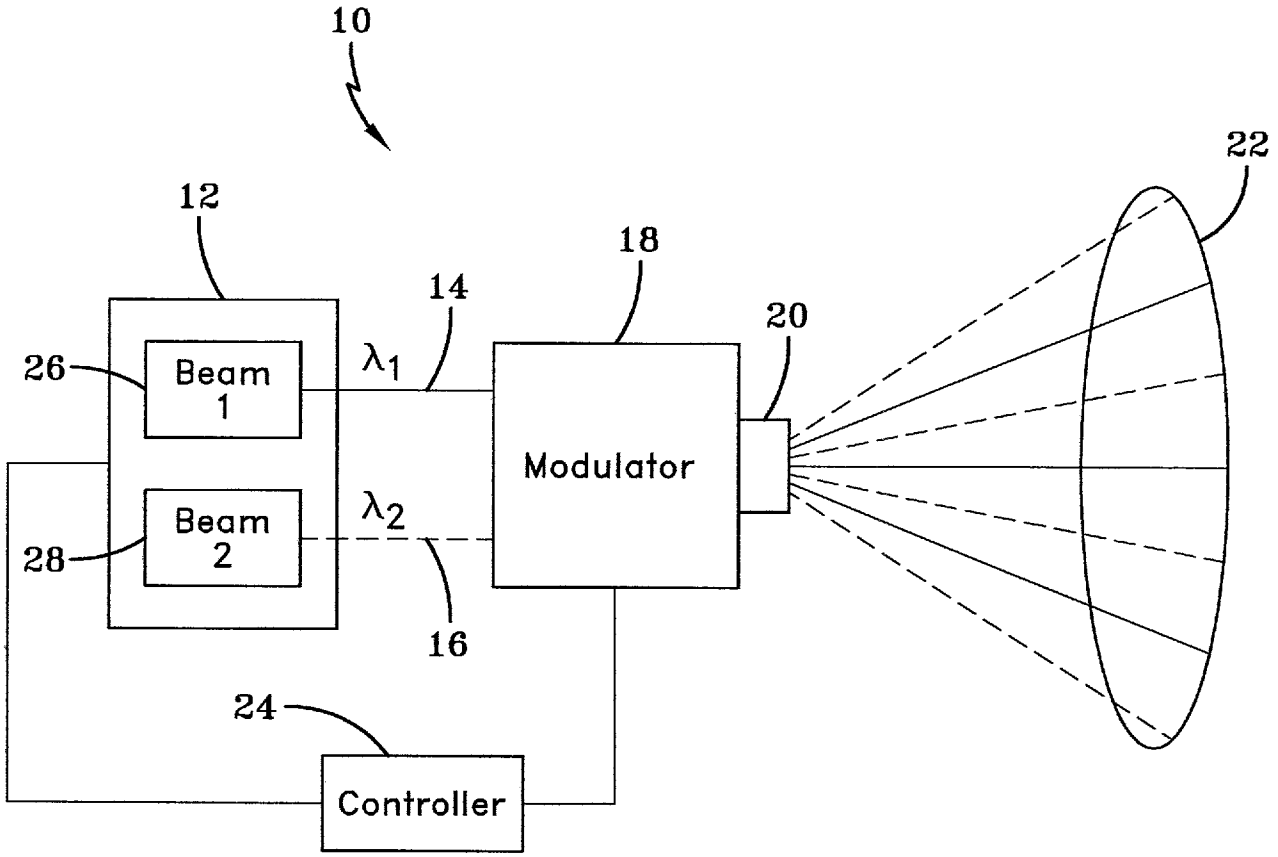
FIG. 1 is a schematic drawing of an example of the device described herein.

FIG. 1 represents a general example of the light shield device 10. The device 10 includes a power supply (not shown), an intense light source 12 capable of producing two or more beams (26, 28) of intense light (14, 16) having different peak wavelengths ($\lambda$1 and $\lambda$2, respectively), and a modulator 18. The modulator 18 can include various means of modulating the intense light beams to create various patterns of light. A projector 20 directs the modulated beams of intense light in a discrete spatial array or pattern 22 such that at least one of the beams has the requisite irradiance to cause visual impairment.

The modulator component 18 can alter the temporal and/or spatial aspects of the intense light source 12 to create: (a) a spatial array of intense light projected onto a targeted area made by one or more beams of light being split into a plurality of beams to produce a pattern of discrete beams separated by a preselected distance, and/or (b) a spatial array of intense light projected onto a targeted area made by one or more beams modulated temporally to produce a beam rasterring/steering pattern. As used herein, a "spatial array" is any pattern or patterns of light illuminating a zone or area that can be produced by spatially or temporally modulating light.

Device 10 has a controller 24 that can act to turn the device ON and OFF, either manually, automatically, remotely or a combination thereof. In some embodiments, the controller 24 can also be used to adjust various parameters of the device such as: beam wavelength, power and intensity. If using a pulsed laser beam, the pulse power, duration and frequency, etc. can also be adjusted. If these parameters are adjusted, characteristics associated with the spatial array will also be adjusted.

The discrete spatial array or pattern of beams 22 eliminates the need for accuracy (i.e. no need for an aiming mechanism to target a person's eye) and makes it very difficult to avoid the beams for a person entering the No-Go zone. In the spatial array of beams 22, each beam may have a stationary (static) pattern, or it may be moving to create a dynamic or temporal pattern, or a combination thereof. In addition, the patterns may be altered at different times (e.g. there may be one pattern in the first X seconds, a different pattern in the next Y seconds, and so on) to produce a varying spatial array.

The intense light beams have different peak wavelengths and a wavelength bandwidth less than 50 nm. In some examples, the wavelength bandwidth is less than 40, 30, 20, 15, 10, 9, 8, 7, 6, 5, 4, 3, 2, or 1 nm. In some embodiments, the beams on intense light may be a laser light (pulsed or continuous wave lasers). In some examples, they may be a strong LED light capable of causing visual impairment or other light sources. "Intense light", as used herein, refers to a beam of light having an irradiance equivalent to X.MPE, where X is 0.1, 0.5, 0.7, 1, 2, 3, 4, 5, 6, 7, 8, 9 or 10, and MPE is the Maximum Permissible Exposure according to ANSI Z136.1.

In some examples, the light beams in the spatial array are laser beams that can cause temporary visual impairment but not permanent eye damage (as defined in ANSI Z136.1).

In some embodiments, the device projects at least one beam in the visible light range (400-700 nm) and at least one beam in the invisible light range (e.g. ultraviolet or infrared wavelengths).

In some embodiments, the device, when on, produces a warning sound, light or both. In some examples, the warning sound can be a loud sound (e.g. flash bang), which is known to cause pupillary dilation and thus increase the target person's vulnerability to light.

The device can be manually controlled, automatically controlled or designed to be remotely controlled by an operator not in the immediate vicinity of the targeted person (e.g. principal's office, local police station, etc.).

The device is designed such that one or more beams of light used to produce the spatial array has the requisite irradiance to cause visual impairment. In a spatial array made of static light spots, one or more light spots have the requisite irradiance. In a spatial array made by rasterring a beam, the beam that is being rasterred has the requisite irradiance.

The design of the device can be varied depending on a number of parameters, including the visual impairment factors, environment factors, modulator factors, and light source factors. The system requirements to achieve visual impairment factors include the irradiance required at each wavelength to achieve the effect, the duration of illumination, the duration of persistence of the illumination, the factors related to whether the intruder is wearing protective eyewear, etc. The environmental factors include the size and shape of the area being illuminated (the "NO-GO visual impairment zone"), range to the targeted intruder, and the presence of scatterers, reflectors, and other environment elements. The modulator factors include the size of the projector as required, the divergence and pattern of the projected beams, the uniformity of illumination, and the pattern (static or dynamic). The light source factors include the irradiance available at each wavelength of light, the wavelength of the beam, and the temporal modulation of the light beams.

The effects and impacts of each of the factors are discussed as follows.

Visual Impairment Factors

"Visual impairment", as used herein, means any impairment of vision that can inhibit, complicate or interfere with functional vision, and/or make target identification or localization more difficult, through the introduction of intense light in the field of view. Visual impairment includes photophobia or photosensitivity as visual discomfort and aversion, glare, flash blindness, startle and/or distraction.

A fundamental function of the retina is to achieve clarity of visual images of objects. The retina processes light through a layer of photoreceptors. When an exposed light source is present in the field of view, the visibility of neighboring objects is impaired due to the visual effects of laser exposure. Distraction/startle, glare/disruption, and flash blindness are all transitory visual effects associated with laser exposure.

"Photophobia" (discomfort and aversion) refers to a sensory disturbance provoked by light. The term "photophobia" (derived from the Greek words "photo" meaning "light" and "phobia" meaning "fear") means, literally, "fear of light" and is a sensory state of light-induced ocular or cranial discomfort, and/or subsequent tearing and squinting.

"Distraction" occurs when an unexpected bright light (e.g. laser or other bright light) distracts a person from performing certain tasks. A secondary effect may be "startle" or "fear" reactions.

"Glare" (sometimes called "dazzle") refers to the temporary inability to see detail in the area of the visual field around a bright light (such as an oncoming car's headlights). Glare is not associated with biological damage. It lasts only as long as the bright light is actually present within the individual's field of vision. Laser glare can be more intense than solar glare and in dark surroundings, even low levels of laser light may cause significant inconvenient glare. Glare that impairs vision is called disability glare. A subtype of glare, "disability glare" is primarily caused by the diffractions and scattering of light inside the eye due to the imperfect transparency of the optical components of the eye and to a lesser extent by diffuse light passing through the scleral wall or the iris. The scattered light overlays the retinal image, thus reducing visual contrast. This overlaying scattered light distribution is usually described as a veiling luminance.

"Flash blindness" is a temporary visual loss following a brief exposure to an abrupt increase in the brightness of all or part of the field of view, similar in effect to having the eyes exposed to a camera flashlight. It is a temporary loss of vision produced when retinal light-sensitive pigments are bleached by light more intense than that to which the retina is physiologically adapted at that moment. An "afterimage", which moves with the eye, persists for several seconds to several minutes after the light source is turned off. This afterimage produces a temporary scotoma (blind spot) in the visual field in which targets are either partially or completely obscured. The time required for temporary flash blindness-induced scotomas to fade increases with the brightness and duration of the light insult. The time it takes before the ability to perceive targets returns depends on several factors, including target contrast, brightness, color, size, observer age, and the overall adaptation state of the visual system. Typically, complete dark adaptation of the visual system takes longer, e.g. 20 to 30 minutes, whereas adaptation to an environment of bright light is usually faster, e.g. completed within 2 minutes. So, under scotopic conditions (low light level or night time light levels), flash blindness will be most drastic and easiest to achieve.

All the visual impairment effects described above are temporary bio-effects and do not cause permanent eye damage.

Irreversible Effects (Permanent Damage)

Permanent or irreversible bio-effects include thermal and hemorrhagic lesions. Thermal lesions are burns of the retinal tissue that result in permanent scotomas. Hemorrhagic lesions are ruptures of the retinal and subretinal blood vessels resulting from thermo-acoustical shockwaves induced in the eye by laser pulses. Simply stated, the light source deposits energy into the eye, which rapidly heats up and produces a shock wave due to the expansion of the vitreous humor, which tears the thin photoreceptor layer of the retina. Lesions can produce immediate and severe permanent visual disruption.

In order to understand the relationship between irradiance and visual impairment, we will begin by providing details regarding the system characteristics as defined by current ANSI Z136.1 protocols.

In some embodiments of the device, continuous wave lasers (that continuously pump and emit light) and/or pulse lasers (lasers where the optical power appears in pulses of some duration at a repetitive rate) can be utilized as light sources. These lasers can be associated with either visible or nonvisible (IR and UV) wavelengths. Possible source-wavelength combinations can be viewed below (Table 1).

TABLE 1

| Source | Wavelength | Combinations |
|---|---|---|
| Pulse Source | Visible, IR, or UV | Pulse-Visible, Pulse-IR, Pulse-UV |
| Continuous Wave (CW) Source | Visible, IR, or UV | CW-Visible, CW-IR, CW-UV |

Some guidelines exist for lasers and their effect on visual impairment. These guidelines account for the energy, duration of impact, and area of impact. All three metrics can be used to sufficiently measure how laser exposure impacts the human eye. For example, the ANSI standard can be used in order to provide reasonable and adequate guidance for the use of lasers and laser systems. This standard defines a maximum permissible exposure (MPE), which is the laser radiation to which an unprotected person may be exposed without adverse biological changes in the eye or skin. In general terms, MPE is usually taken as 10% of the threshold irradiance that has a 50% probability of causing permanent damage under worst-case conditions.

Table 2 sets out the current ANSI standard for the irradiance ($W/cm^2$) threshold for different visual impairment effects.

TABLE 2

ANSI threshold irradiance ($W/cm^2$) for different visual impairment effects

| Visual Effect | Irradiance Threshold ($W/cm^2$) |
|---|---|
| Maximum Permissible Exposure (MPE) | $2.5 \times 10^{-3}$ |
| Afterimages, flashblindness | $1 \times 10^{-4}$ |
| Glare | $5 \times 10^{-6}$ |
| Startle, distraction | $5 \times 10^{-8}$ |

Table 3 shows some examples taken from current ANSI Z136.1 Table 5a, sets out the Maximum Permissible Exposure (MPE) for point source ocular exposure to a laser beam.

TABLE 3

ANSI Maximum Permissible Exposure (MPE) values for point source ocular exposure to a laser beam

| Wavelength (nm) | Exposure Duration (s) | MPE:H ($J/cm^2$) | MPE ($W/cm^2$) | |
|---|---|---|---|---|
| 315-400 | 10 to $3 \times 10^4$ | 1 | | Photochemical Effects |
| 400-700 | $18 \times 10^{-6}$ to 10 | $1.8t^{0.75} \times 10^{-3}$ | | Visible Effects |
| 400-450 | 10 to 100 | $1 \times 10^{-2}$ | | Photochemical Effects |
| 500-700 | 10 to $3 \times 10^4$ | | $1 \times 10^{-3}$ | Visible Effects |
| 700-1050 | $18 \times 10^{-6}$ to 10 | $1.8C_A t^{0.75} \times 10^{-3}$ | | $C_A = 10^{2(\lambda-0.7)}$; $\lambda$ in μm |

Table 4 shows some examples, taken from ANSI Z136.1 Table 5b, of Maximum Permissible Exposure (MPE) for extended source ocular exposure to a laser beam.

TABLE 4

ANSI Maximum Permissible Exposure (MPE) for extended source ocular exposure to a laser beam

| Wavelength (nm) | Exposure Duration (s) | MPE:H ($J/cm^2$) | MPE ($W/cm^2$) | |
|---|---|---|---|---|
| 400-700 | $18 \times 10^{-6}$ to 0.7 | $1.8C_E t^{0.75} \times 10^{-3}$ | | Visible Effects $C_E = 1$ for $\alpha < \alpha_{min}$ $C_E = \alpha/\alpha_{min}$; $\alpha_{min} < \alpha < \alpha_{max}$ |
| 400-700 | 0.7 to $T_2$ | $1.8C_E t^{0.75} \times 10^{-3}$ | | Thermal Effects $C_E = 1$ for $\alpha < \alpha_{min}$ $C_E = \alpha/\alpha_{min}$; $\alpha_{min} < \alpha < \alpha_{max}$ $T_2 = 10s$ for $\alpha <$ 1.5 mrad; $T_2 = 100$ for $\alpha >$ 100 s mrad $T_2 = 10 \times 10^{(\alpha-1.5)/98.5}$ |
| 700-1050 | $18 \times 10^{-6}$ to $T_2$ | $1.8C_A C_E t^{0.75} \times 10^{-3}$ | | $C_A = 10^{2(\lambda-0.7)}$; $\lambda$ in μm |

Each of the combinations in Table 1 have a damage threshold that depends on the amount of energy, where said energy can be determined using the formula: (E)=Power (P)×Time (T). For example, when the eye is exposed to a CW laser beam at 532 nm (peak emission), with a spot size of 0.7 cm in diameter, 0.5 mW ($5\times10^{-4}$ watts) of power and for a time period of 250 ms (0.25 seconds, which is the typical blink time), the Energy (E)=($5\times10^{-4}$ W)×(0.25 sec)=$1.25\times10^{-4}$ J=$1.25\times10^{-1}$ mJ. When referring to Table 3, the MPE for visible lasers for wavelength between 0.4 and 0.7 μm for exposure duration from 18 μs to 10 s is given by:

$$\text{MPE}:H=1.8t^{3/4}\ \text{mJ/cm}^2$$

For a 0.25 s exposure, the MPE:H is $1.8\times0.25^{3/4}$ $mJ/cm^2$=(1.8×0.354) $mJ/cm^2$=0.637 $mJ/cm^2$. For a single exposure, the irradiance of the laser light may be found by dividing the radiant fluence exposure, H, by the exposure duration, t:

$$E=(\text{Energy/Area})/(\text{Time})=H/t=$$

For a radiant fluence exposure (H) of 0.637 $mJ/cm^2$ for 0.25 s, the irradiance (E) is:

$$\text{MPE}=[0.637\ \text{mJ/cm}^2]/[0.25\ \text{s}]=2.5\ (\text{mW/cm}^2)$$

Given this irradiance value, we can use Table 2 to identify the corresponding visual effect. In the example above, the irradiance ($P/A=0.5\ mW/\pi(0.35)^2=1.3\ mW/cm^2$) value is below the MPE threshold of $2.5\times10^{-3}$ W/cm$^2$. When taking this into account, using $1.3\times10^{-3}$ W/cm$^2$ of irradiance would meet the current ANSI standard.

Other relevant parameters are defined below:

Nominal Ocular Hazard Distance (NOHD): The distance along the axis of unobstructed beam from a laser to the human eye beyond which the irradiance is not expected to exceed the applicable MPE, as defined in ANSI-Z136.1.

Eye injury Distance (ED50) (D1): The location along a beam path where the exposure at 10 times the MPE is at 31.6% of the NOHD. There we have 50/50 chance of causing retinal damage.

Sensitive Zone Exposure Distance (SZED)(D2)—The beam is bright enough to cause temporary vision impairment (flash blindness), from the source to this distance.

Critical Zone Exposure Distance (CZED)(D3)—The beam is bright enough to cause a distraction interfering with critical task performance, from the source to this distance (Glare).

"Laser-Free" Exposure Distance (LFED)—Beyond this distance, the beam is dim enough that it is not expected to cause a distraction.

Although ANSI MPE parameters have been used as an example above, other groups that have also standardized the performance and safety of manufactured laser products may be used in addition to or as a substitution to the regulations listed above. Further, the system measures may be adjusted, at any time, to account for regulatory changes made to any of the standards available.

Environmental Factors

One of the environmental factors to consider is the divergence of the beam relative to the distance to the targeted region and desired beam spot size at the targeted area. For the small hand-held devices, the beam diameter remains smaller than the separation of eyes for short distance and in some embodiments, it is advantageous to provide a beam divergence capability. Therefore, in some embodiments, it is desirable to have the ability to vary the divergence (zoom the illuminator) of the beam depending on the location of the device relative to the location, length, width, size or shape of the targeted area, etc. In other embodiments, the device can be made to accommodate for the divergence of the beams.

Figure 2:
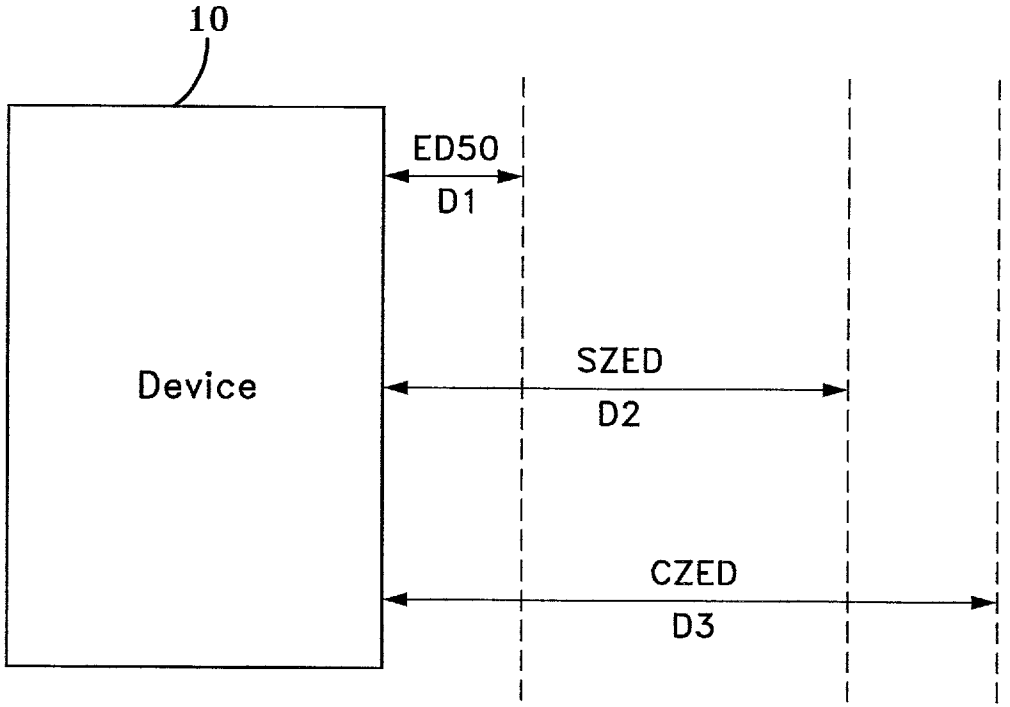
FIG. 2 is a schematic drawing of an example of an eye-impairment zone created by the device.

The presence of eyeglasses, dark glasses, goggles, or other eyewear, and filters may block the intense light beams to propagate through the eye. The device as designed here includes a plurality (two or more) intense light beams that can be modulated in space and/or time. In addition, the different wavelengths of the intense light beams make it more difficult to block out any particular wavelength. For example, in the embodiment as shown in FIG. 2, the blue laser operates in the 400-500 nm range; the green laser is operative to generate light at a wavelength of 500 nm to 580 nm, the infrared laser is operative to generate light at a wavelength of 700 nm to 1500 nm, and the red laser is operative to generate light at a wavelength of 580 nm to 700 nm. In this manner, if the intruder attempts to counter the visual impairment effect by using dark glasses, such dark glasses will have to be broadband or neutral density, which inevitably reduces the ability of the intruder to visualize his surroundings, especially in low light conditions.

Another environmental factor is the ambient light conditions. It is well known that the effect of intense light visual impairment is enhanced when ambient light is low. In addition, low light conditions cause pupillary dilation, allowing more light to enter the eye. There is also increased readaptation time (about 20 minutes) so the effects of afterimage will have more impact. Therefore, in some embodiments, the device can be synched with a module that controls ambient lighting (e.g. the lighting inside a building, the corridors, hallways, classrooms, etc.) and programmed so that when an intruder enters and the device is turned on, a controller simultaneously reduces ambient lighting by dimming or turning off lights, or by shading windows, etc., thus increasing the effectiveness of the visual impairment.

Although two environmental factors have been discussed, additional environmental factors (e.g., scatterers, reflectors, etc.) may also be considered.

Light Source Factors

Several light source factors can be altered to meet the desired parameters. The factors include, but are not limited to, the wavelength, variation, repetition frequency, intensity (irradiance and illuminance), and the pulse-to-cycle ratio.

Wavelength

The beams of intense light (light that can induce visual impairment) used in the device can have any wavelength in the visible range (400-700 nm), the near infrared range (700-1500) and the ultraviolet range (310-400 nm). The choice of which intense light wavelength to use will depend on a number of factors such as effectiveness in causing visual impairment, size, weight, power, amenability to temporal modulation, and beam quality (brightness). The term "peak wavelength" means the wavelength in the emitted light which carries the most irradiance.

It is known that different wavelengths of intense light have different effects on the eye and influence the effectiveness of visual impairment in various environments. For example, the optimal sensitivity of the eye during daytime (photopic vision using cones) is at 555=(green), and at night (scotopic vision with rods), is at 505 nm (blue-green). At shorter wavelengths—towards the blue end of the spectrum (350-450 nm)—absorbance by the lens causes fluorescence which in turn produces intraocular veiling glare (480-520 nm).

For example, green light, with peak wavelength range of 500-580 nm, can effectively disrupt tracking performance. Operators use the central part of their visual field (the fovea) in which cone vision dominates to accurately track targets. For the detection and tracking of small objects, the L and M-cones with peak sensitivity at 530 and 560 nm, respectively, are most important. This implies that for maximum interference with an operator's task, it is preferable to disable both the L and M cones. So in some examples, it is considered that a single wavelength of 545 nm (halfway in between 530 and 560 nm) would be optimally suited to achieve this goal and in some of the device, one or more of the light beams may be chosen to have this wavelength range. For example, studies embodiments conducted on military personnel suggest that a wavelength of around 545 nm is preferred for inducing flash blindness since it will simultaneously affect the L and M cones that are required for target tracking.

Other factors can also affect the choice of wavelength. For example, there is a significant amount of fluorescence that occurs when objects are illuminated with ultraviolet light. When the goal is to achieve wavelength versatility, different wavelength light sources or lasers should be incorporated into the light source component. In FIG. 1, each intense light or laser source is operative to generate a wavelength range of light. A typical classification of various lasers is shown in Table 5. The values in Table 5 are taken from Table C 1 in current ANSI Z136.1.

TABLE 5

Typical Laser Classification-CW Point Source Lasers

| Wavelength (nm) | Class 1 (W) | Class 2 (W) | Class 3** (W) | Class 4 (W) |
|---|---|---|---|---|
| 315-400 | ≤3.2 × 10−6 | None | >Class 1 but ≤ 0.5 | >0.5 |
| 441.6 | ≤4 × 10−5 | Class 1 but ≤ 1 × 10−3 | Class 2 but ≤ 0.5 | >0.5 |
| 488 | ≤2 × 10−4 | Class 1 but ≤ 1 × 10−3 | Class 2 but ≤ 0.5 | >0.5 |
| 514 | ≤4 × 10−4 | Class 1 but ≤ 1 × 10−3 | Class 2 but ≤ 0.5 | >0.5 |
| 532 | ≤4 × 10−4 | Class 1 but ≤ 1 × 10−3 | Class 2 but ≤ 0.5 | >0.5 |
| 632 | ≤4 × 10−4 | Class 1 but ≤ 1 × 10−3 | Class 2 but ≤ 0.5 | >0.5 |
| 670 | ≤4 × 10−4 | Class 1 but ≤ 1 × 10−3 | Class 2 but ≤ 0.5 | >0.5 |
| 780 | ≤5.6 × 10−4 | None | >Class 1 but ≤ 0.5 | >0.5 |

Variation

In some examples, the light beam can be made to have temporal variation in intensity or be pulsed to enhance its effectiveness. In one example, a unit composed of 3 different wavelengths can pulse or produce a continuous-wave emission. The blue and red wavelengths may pulse while the green wavelength is a continuous-wave. The pulsed lasers may vary output at a rate between 7 Hz and 20 Hz. This can be done by varying the input current. In the same example, the continuous-wave laser (green laser) can be produced by a continuous-wave (CW) diode pumped $Nd^{3+}$ laser with an optical frequency doubler that converts the near infrared light into the green wavelength. These doubled Nd lasers can be designed to operate continuously.

The intense light source can also be a bright light emitting diodes. These devices can produce very bright quasi directional beams of colored light centered at different wavelengths. Typically, they have a Full Width at Half Maximum-FWHM of less than 50 nm. This allows a semi-broadband emitter which can be used to glare a targeted area.

Repetition Frequency

In case a modulated intense light is used as one or more intense light beams, the frequency can be pre-determined or adjusted as necessary. In some embodiments, the modulation frequency is between 1 and 30 Hz and is used to create maximum discomfort. After 30 Hz, the eyes see it as being continuous. In some examples, the frequency can be 5, 10, 15, 20, 25 or 30 Hz.

Irradiance

Different intensity levels can produce different visual impairment effects. For example, for flash blindness, the irradiance of a flash required to obtain a certain recovery time depends on irradiance of the light source, background luminance (pupil size and initial adaptation state of the observer), and the ambient-background contrast. For flicker, the degree of discomfort depends on the modulation depth (difference between maximum and minimum light irradiance). Pulsed lasers may also be used to counter the blink reflex and may also cause additional startle and distraction.

The ANSI Z136.1 standard defines laser irradiance ($W/cm^2$) threshold exposure levels for visual interference. Examples of the laser irradiance threshold levels corresponding to the different visual interference effects are shown in Table 2.

The device may have a light source capable of producing a light beam having an irradiance ⅒th below MPE up to 2, 3, 4, 5, 6, 7, 8, 9, 10 times or more above the MPE for each light beam generated in a particular zone (D1, D2, D3 in FIG. 2). Thus, the irradiance of each light beam used may range from $nW/cm^2$ to $\mu W/cm^2$ to $\mu W/cm^2$ to several hundred $mW/cm^2$ to a few $W/cm^2$ depending on the characteristics of the spatial array.

Pulse-to-Cycle Ratio

The transitions from dark to bright (and vice versa) should be as fast and strong as possible to induce maximum discomfort.

Although the factors cited above are examples of the light source factors that were considered, it should be mentioned that there are several additional factors that drive the light source selections, including, but not limited to, visibility of the light (lumen), effectiveness in creating visual impairment, light wavelength, size and weight of the source, power input, amenability to temporal modulation, and beam quality (brightness).

Modulator Factors

The modulator component 18 can alter the temporal and/or spatial aspects of the intense light source 12 to create: (a) a spatial array of intense light projected onto a targeted area made by one or more beams of light being split into a plurality of beams to produce a pattern of discrete beams, and/or (b) a spatial array of intense light projected onto a targeted area made by one or more beams modulated temporally to produce a beam rasterring/steering pattern.

Rasterring (or steering) is the ability to scan a pattern from side to side and from top to bottom. Rasterring can be accomplished mechanically and/or without a mechanical means. Mechanical steering can be achieved by several methods, including rotating mirrors driven by a stepper, galvanometer motors or mounted on gimbaled mechanisms driven by piezoelectric actuators or with rotating prisms or DOE, for example. Non-mechanical beam steering can be achieved through means such as acousto-optic deflection, electro-optic deflection and the use of spatial light modulators, for instance. In some embodiments, a reflective light valve (a set of mirrors, for example) is used to create the rasterring pattern. Rasterring can be applied to each of the beams of intense light.

In some embodiments of the device, a combiner can be used to mix two or more beams of light with two or more different wavelengths. Accordingly, for example, the combiner can combine two or more wavelengths to colinearly propagate, so a single raster can then produce a temporal pattern of all said combined wavelengths simultaneously. One advantage of such a system, for example, is that the intruder will see a single color that may be composed of several wavelengths, therefore making it harder to protect against all the wavelengths.

In some embodiments, beam modulation can be achieved but not limited by the addition of a mechanical or/and an optical component to each beam such that the output beam direction and/or irradiance is variable in space and/or time. Such a spatial array increases the effectiveness of the device in producing visual impairment, e.g. because the intruder will not be able to easily move to a spot where the light will not affect his/her vision.

For example, one type of modulation can be achieved by: first, using a beam splitter which functions to create multiple beams (two or more) from the same beam and a projector which projects the beams into a space in a specific direction as a function of time. For instance, a beam splitter such as a prism or diffractive optical element (DOE) may be used that can split each beam of light into multiple (two or more) beams. A beam steering element can be used to alter the exposure to a beam at a particular location on the target. In some embodiments, the modulator is a single system performing both splitting and directing of the beams. In other embodiments, the role of splitter and projector are separated. In some embodiments, the projector 20 may use various lenses or other means for varying the divergence or spatial relationship of the beams depending on the size, shape and environmental factors affecting the area to be illuminated. In some embodiments, a reflective light valve and/or a refractive light valve may be used to modulate the beams.

In some embodiments, the projector 20 includes an intelligent control device for automatically controlling the pulse duration and power for individual wavelength of light.

Pre-Set or Adjustable Controls

In some embodiments, the device may be furnished with one or more pre-set controls, each with a pre-set set of parameters for the light source, type and intensity of beams, projection and spatial array settings, etc. For example, the device can have just one on-/off button to turn it on or off. Alternatively, it can have various pre-set settings each of which can be turned on or off. In some embodiments, various parameters can be controlled, either manually, automatically, remotely, or a combination of these. For example, the output power, wavelength, beam spread, pulse frequency/width/duration (in case of pulsed lasers) for any beam of intense light may be adjustable according to the distance or size and characteristics of the targeted area to ensure the light is effective in causing visual impairment.

In some embodiments, a control means (e.g. remotely activated control or mechanically accessible switch, etc.) may be used to vary various parameters of the device, e.g. the power levels of the light beams. For example, depending on lighting conditions, the power of a red or violet beam can be changed from 4 mW to 480 mW and 0.5 mW to 500 mW, respectively. A green beam (e.g. green laser) can be adjustable from less than 1 mW to 1400 mW or higher. Similarly, an infra-red laser beam can be adjusted to have a power of from less than 1 mW to greater than 2000 mW. Other color light beams may be adjusted as necessary.

However, it must be noted that these numbers may be higher up to the allowable max power, e.g. up to several watts.

If a pulsed laser is used, the pulse duration of the laser (e.g. red, green, blue, violet, etc.) can be controlled by a controller.

The values of the powers and the pulse durations cover a range of operation of the intense light or laser and the anticipated range of operation for the visual impairment effect (e.g. D1, D2 and D3 in FIG. 2). In addition to manual operation, the above parameters can also be controlled remotely, or automatically controlled by an active sensor system.

Flicker—in some embodiments, the beam of intense light may flicker—defined as light that varies rapidly in brightness. Flicker as used herein includes both "luminance" (luminous intensity per unit area) flicker and "chromaric" flicker.

Studies on the visual effects due to dynamic changes in light level reveal that flickering lights within the frequency range 2-25 Hz are perceived as disturbing. At 10 Hz the subjective brightness of flickering lights is at maximum, known as the Brucke-Bartley effect. The rate of discomfort depends on the modulation depth and the intensity time profile of the flicker. The modulation depth is defined as the difference between the maximum and minimum light level. The shape of the intensity profile with time also determines effectiveness of the flicker: short flashes in which the duration of the ON-cycle is less than 25% of the total ON-OFF cycle (the so called pulse-to-cycle ratio) are visually most effective. Perceived discomfort also depends on the size of the light source: the larger the visual angle of the light source in the visual field, the more discomfort is experienced. This is typically expected when the intensity (irradiance) of the light source is kept constant. When keeping retinal illuminance (i.e., the amount of light falling upon the eye) fixed, the discomfort increases with decreasing light source area.

Luminance flicker (temporal intensity modulations of bright lights) can trigger additional adverse physiological and psychological symptoms, ranging from vertigo, disorientation, mild headaches and muscle spasm to convulsions or epileptic seizures. These effects increase with the intensity of the source and are usually stronger when the light is spatially scanning through a pattern. Bright and flickering light sources that cover the majority of the visual field are most effective in disrupting the normal brain activity.

Chromatic flicker (temporal chromaticity modulations of bright lights) can trigger sustained cortical excitation and/or discomfort even in normal subjects, which is largest at a driving frequency of 10 Hz, and strongest for Red/Blue flicker, followed by Blue/Green and Red/Green. Red-blue flicker is most provocative below 30 Hz. Given the above, in some examples, the device may include a flicker or strobing effect, either with regard to the beams of intense light being projected, or in addition to those.

Eye Protection

The various parameters (wavelength, intensity, etc.) of the light may be adjustable in order to adapt to the fact that the intruder may be wearing eye protection. ANSI Z136.1 provides the parameters and correction factors in Table 6 (reproduced below). Table 7 (reproduced from current ANSI 2136.1) sets forth visual correction factors (VCF) for visible lasers.

The term "Visually Corrected Power" used in this document is the same as "effective irradiance." The Visual Correction Factor used in this table (CF) is the CIE normalized efficiency photopic visual function curve for a standard observer.

TABLE 6

Parameters and Correction Factors

| Parameter/ Correction Factors | Wavelength (μm) | Figure with Graphical Representation |
|---|---|---|
| $C_A = 1.0$ | 0.400 to 0.700 | 8a |
| $C_A = 10^{2\ (\lambda-0.700)}$ | 0.700 to 1.050 | 8a |
| $C_A = 5.0$ | 1.050 to 1.400 | 8a |
| $C_B = 1.0$ | 0.400 to 0.450 | 8c |
| $C_B = 10^{20\ (\lambda-0.450)}$ | 0.450 to 0.600 | 8c |
| $C_C = 1.0$ | 1.050 to 1.150 | 8b |
| $C_C = 10^{18\ (\lambda-1.150)}$ | 1.150 to 1.200 | 8b |
| $C_C = 8$ | 1.200 to 1.400 | 8b |
| $C_E = 1.0\ \alpha < \alpha_{min}$* | 0.400 to 1.400 | — |
| $C_E = \alpha/\alpha_{min}\ \alpha_{min} \le \alpha \le \alpha_{max}$* | 0.400 to 1.400 | — |
| $C_E = a^2/(\alpha_{max}\ \alpha_{min})\ \alpha > \alpha_{max}$* | 0.400 to 1.400 | — |
| $C_P = n^{-0.25}$ ** | 0.180 to 1000 | 13 |
| $T_1 = 10 \times 10^{20\ (\lambda-0.450)}$ *** | 0.450 to 0.500 | 9a |
| $T_2 = 10 \times 10^{(\alpha-1.5)/98.5}$ **** | 0.400 to 1.400 | 9b |

*For wavelengths between 0.400 and 1.400 μm: $\alpha_{min}$ = 1.5 mrad, and $\alpha_{max}$ = 100 mrad

** See 8.2.3 for discussion of $C_P$ and 8.2.3.2 for discussion of pulse repetition frequencies below 55 kHz (0.4 to 1.05 μm) and below 20 kHz (1.05 to 1.4 μm).

*** $T_1$ = 10 s for $\lambda$ = 0.450 μm, and $T_1$ = 100 s for $\lambda$ = 0.500 μm.

**** $T_2$ = 10 s for $\alpha$ < 1.5 mrad, and $T_2$ = 100 s for $\alpha$ > 100 mrad.

Note 1:

Wavelengths must be expressed in micrometers and angles in milliradians for calculations.

Note 2:

The wavelegnth region $\lambda_1$ to $\lambda_2$ means $\lambda_1 \le \lambda < \lambda_2$, e.g., 0.550 to 0.700 μm means 0.550 ≤ $\lambda$ < 0.700 μm.

TABLE 7

| VISUAL CORRECTION FACTOR FOR VISIBLE LASERS Use for visible lasers only (400-700 nm). | | |
|---|---|---|
| Laser Wavelength (nm) | Visual Correction Factor (VCF) | |
| 400 | $4.0 \times 10^{-4}$ | |
| 410 | $1.2 \times 10^{-3}$ | |
| 420 | $4.0 \times 10^{-3}$ | |
| 430 | $1.16 \times 10^{-2}$ | |
| 440 | $2.30 \times 10^{-2}$ | |
| 450 | $3.80 \times 10^{-2}$ | |
| 460 | $5.99 \times 10^{-2}$ | |
| 470 | $9.09 \times 10^{-2}$ | |
| 480 | $1.391 \times 10^{-1}$ | |
| 490 | $2.079 \times 10^{-1}$ | |
| 500 | $3.226 \times 10^{-1}$ | |
| 510 | $5.025 \times 10^{-1}$ | |
| 520 | $7.092 \times 10^{-1}$ | |
| 530 | $8.621 \times 10^{-1}$ | |
| 540 | $9.524 \times 10^{-1}$ | |
| 550 | $9.901 \times 10^{-1}$ | |
| 555 | $1.0 \times 10^{0}$ | (VCF = 1) |
| 550 | $9.901 \times 10^{-1}$ | |
| 570 | $9.524 \times 10^{-1}$ | |
| 580 | $8\ 696 \times 10^{-1}$ | |
| 590 | $7.576 \times 10^{-1}$ | |
| 600 | $6.329 \times 10^{-1}$ | |
| 610 | $5.025 \times 10^{-1}$ | |
| 620 | $3.817 \times 10^{-1}$ | |
| 630 | $2.653 \times 10^{-1}$ | |
| 640 | $1.751 \times 10^{-1}$ | |
| 650 | $1.070 \times 10^{-1}$ | |
| 660 | $6.10 \times 10^{-2}$ | |
| 670 | $3.21 \times 10^{-2}$ | |
| 680 | $1.70 \times 10^{-2}$ | |
| 690 | $8.2 \times 10^{-3}$ | |
| 700 | $4.1 \times 10^{-3}$ | |

Translating the ANSI parameters, in such cases, the MPE thresholds change are shown below in tables 8-9. (Note, Table 8 shows the threshold levels for an unprotected eye).

TABLE 8

| Broadband Irradiance threshold exposure levels (protected eye; medium to dark shade). | |
|---|---|
| Visual Effect | Irradiance Threshold (W/cm2) |
| MPE | 31.0 × 10−3 |
| Afterimages, flash blindness | 12.5 × 10−4 |
| Glare | 62.5 × 10−6 |
| Startle, distraction | 62.5 × 10−8 |

TABLE 9

| Broadband illuminance threshold exposure levels (protected eye; light shade). | |
|---|---|
| Visual Effect | Irradiance Threshold (W/cm2) |
| MPE | 6.3 × 10−3 |
| Afterimages, flash blindness | 2.5 × 10−4 |
| Glare | 12.5 × 10−6 |
| Startle, distraction | 12.5 × 10−8 |

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

Some examples of the device and its operation are presented below.

Example 1

Figure 3B:
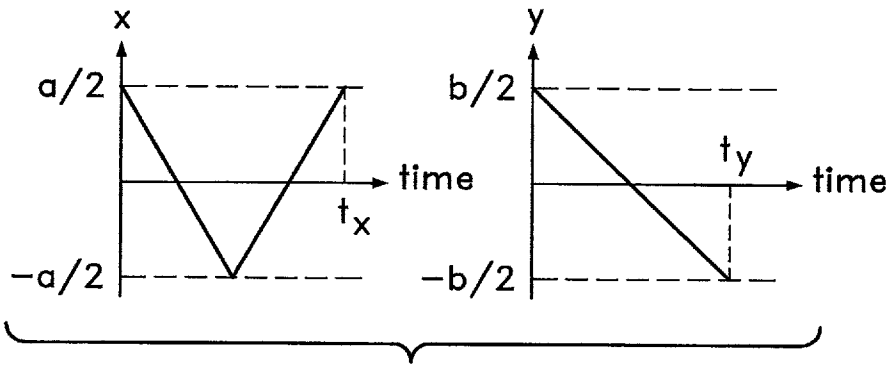
FIG. 3B is a graph representing an array pattern used in the device of FIG. 3A.
Figure 3A:
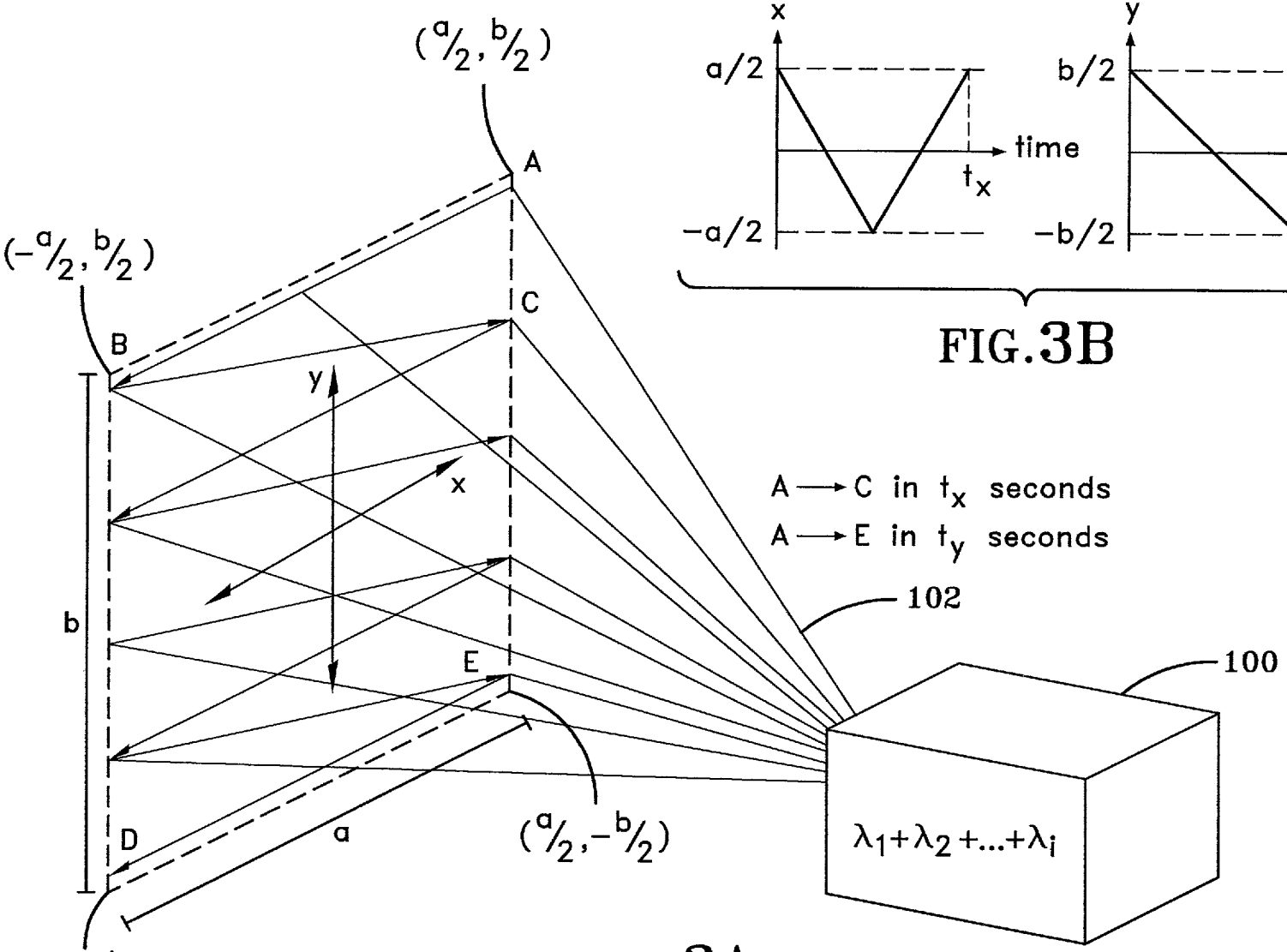
FIG. 3A is a schematic drawing of an example of the device described in Example 1.

One example of the device, shown in FIGS. 3A and 3B, has the following features: a) $Beam_1$: CW monochromatic light source at λ1; b) $Beam_{2,3}$: Double CW monochromatic light source at λ2 and λ3; c) $Beam_4$: Broad-band CW/pulsed visible light source; and d) Modulator: Beam steering system and integrated optics This system includes a $Beam_1$ (a single light source) with red emission and $Beam_{2,3}$ (a double light source) with green and NIR emissions. In addition, the system also includes $Beam_4$ (the broad band CW/pulsed light source) that, when included in the system, causes the source to transition from a dazzling (discomfort glare) source to a disability (glare, flash blindness) source (e.g. using the CW Lasers systems).

FIG. 3A shows a $Beam_i$ 102 (where i=1, 2, 3, 4, . . . n). Beam 102 may represent any of the beams above ($Beam_1$, $Beam_{2,3}$, $Beam_4$, etc.). FIG. 3A shows the coordinates of the array associated with Beam 102 when the beam is projected onto the No-Go zone 104, for example the entrance to a building, an internal corridor, a doorway of a security van, etc. Each beam has a wavelength $\lambda_i$ (where i=1, 2, 3, 4, . . . n) between 380-1550 nm.

In this example, initial coordinates of Beam (represented by point A) are (a/2, b/2). As this point moves in the direction of the arrows, the point begins to oscillate as it transitions from (a/2, b/2) to (−a/2, b/2) and then from (−a/2, b/2) to (a/2, b/2−$L_a$), where $t_x$ is the time that it takes to travel from point A to point B. The point continues to oscillate until it arrives at point C. The time period required to travel from point A to point C is $t_y$.

Now referring to FIG. 3B, we see that the "x-axis" and "y-axis" graphs correspond to what we've described above. $Beam_i$ 102 (where i=1, 2, 3, 4, . . . n) oscillates back and forth along the x-axis from (a/2) to (−a/2) and from (−a/2) back to (a/2) over time period $t_x$. In a similar manner, the "y-axis" graph corresponds to what is described above, i.e. the same $Beam_i$ 102 (where i=1, 2, 3, 4, . . . , n) oscillates back and forth along the y-axis from (b/2) to (−b/2) and then from (−b/2) back to (b/2). This occurs over a time period ($2t_y$) and it takes a time period of $t_y$ to travel from (b/2) to (−b/2) and an additional time period of $t_y$ to travel from (−b/2) back to (b/2).

In this example, the described model applies to $Beam_i$ 102 (where i=1, 2, 3, 4, . . . n). However, the coordinates and oscillation time intervals for each beam may vary or may be the same. In addition, the system can have a combination of dynamic patterns (as shown) and static patterns, or any combination of spatial arrays, as required.

Example 2

Figure 4:
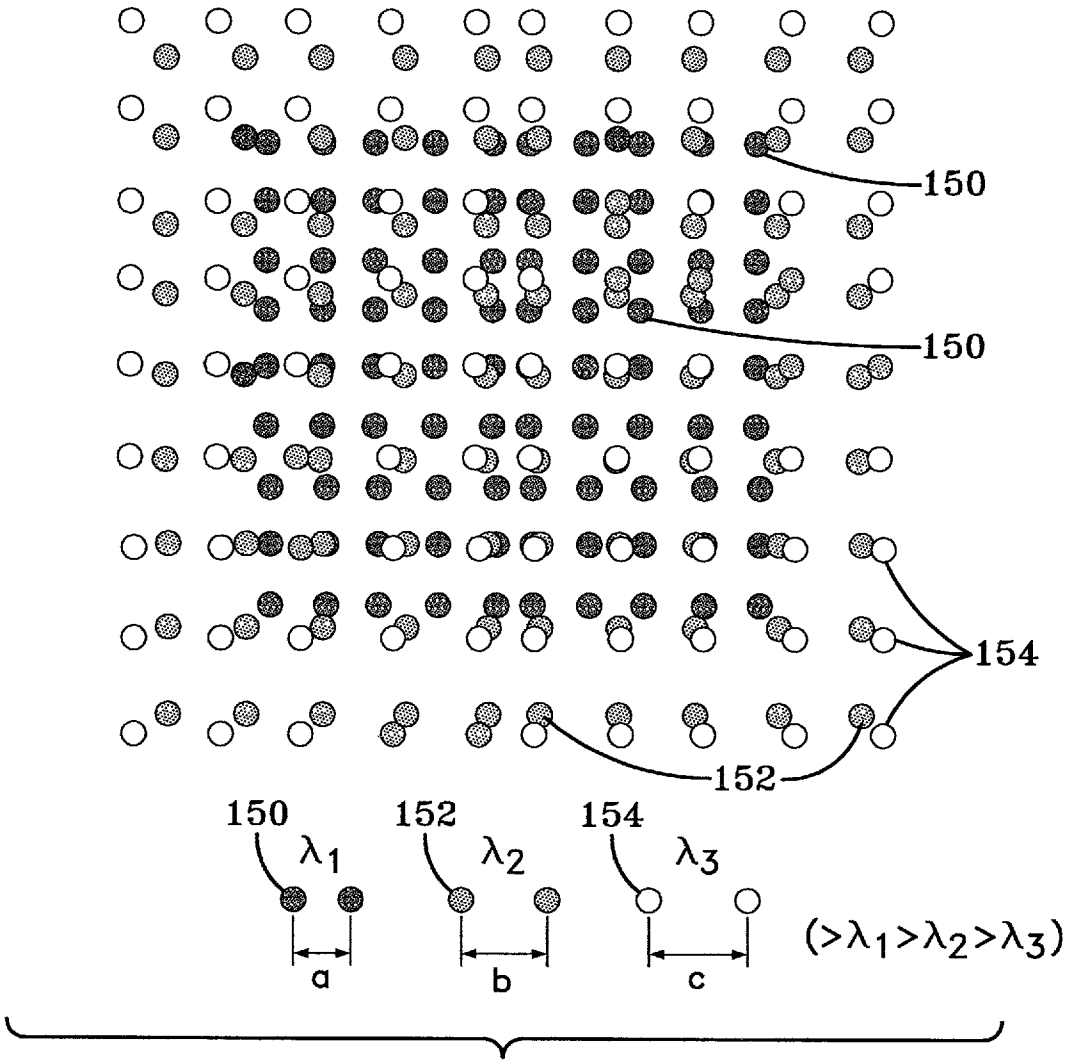
FIG. 4 is a schematic drawing of an example of different spatial array patterns for lights having different wavelengths.

Another example of the contemplated device produces a pattern shown in FIG. 4. In this device, $Beam_1$ is a CW triple laser light source at $\lambda_1$, $\lambda_2$ and $\lambda_3$. The modulator includes a Diffractive Optical Element (DOE).

This system includes $Beam_1$ with blue ($\lambda_1$ 150), green ($\lambda_2$ 152) and red ($\lambda_3$ 154) emissions, where $\lambda_1$ 150$<\lambda_2$ 152$<\lambda_3$154. $Beam_1$ may optionally include a broad band CW/Pulsed light source as well. If the broad band CW/Pulsed light source is added to the source, the system transition from a dazzling (discomfort glare) source to a disability (glare, flash blindness) source (e.g. using the CW Lasers systems). When a modulator that includes the DOE is used, a pattern that shows a distribution in space of several wavelengths is generated. Note, this pattern can be static or dynamic. In this example, the irradiance at the entrance of the No-Go zone is $\leq 6\times10^{-4}$ W/cm$^2$.

Example 3

Figure 5:
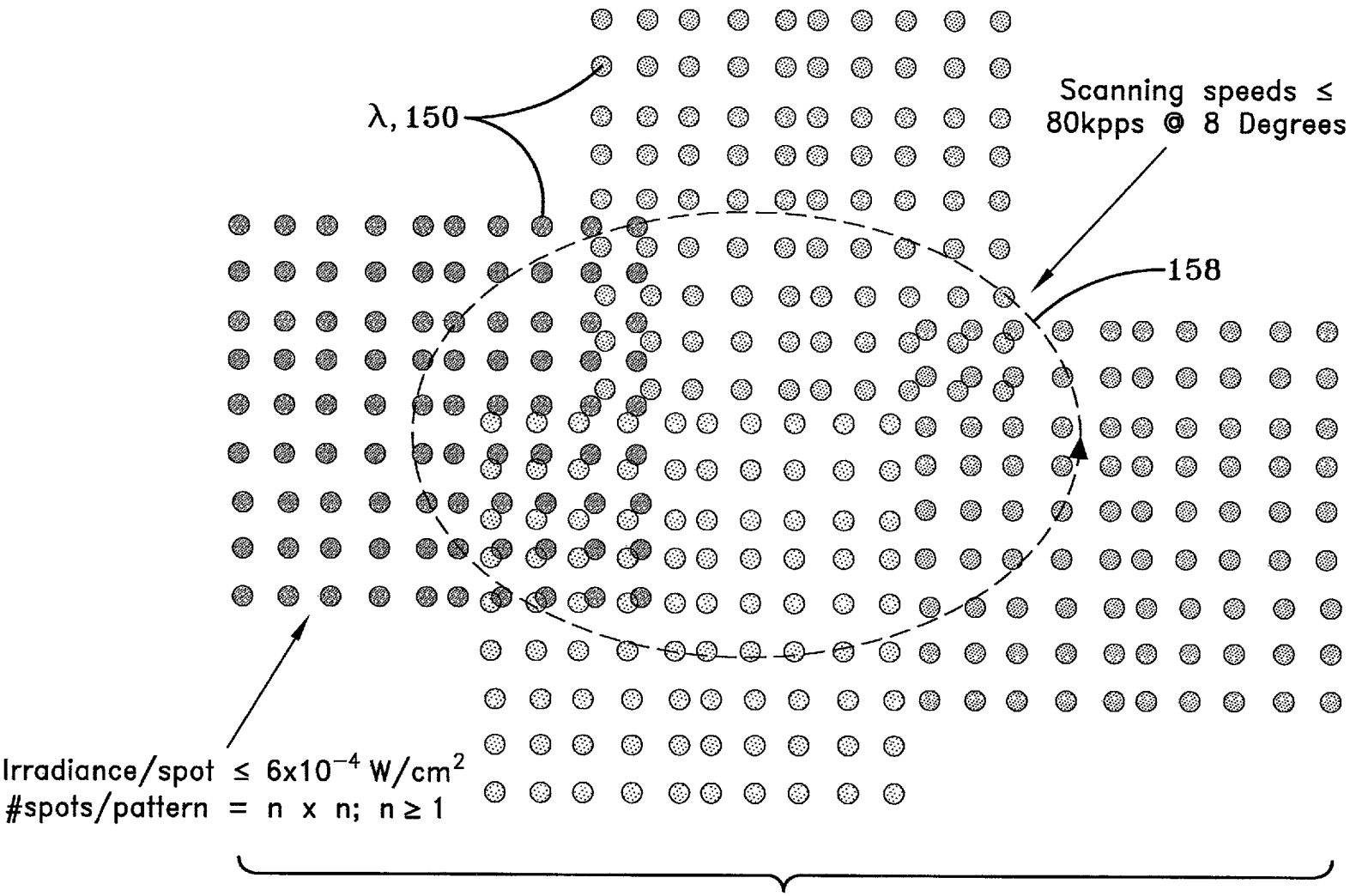
FIG. 5 is a schematic drawing of another example of different spatial array patterns for lights having different wavelengths.

Another example of the contemplated device produces a pattern shown in FIG. 5 (for only one beam 150). This system includes a CW dual laser light source at $\lambda_1$ and $\lambda_2$ (so $Beam_1$ includes two wavelengths $\lambda_1$ 150 and $\lambda_2$ 156. In this example, the source $Beam_1$ includes green and infrared emissions, corresponding to $\lambda_1$ 150 and $\lambda_2$ (not shown) respectfully. If the broad band CW/Pulsed light source is added to the source, the system transition from a dazzling (discomfort glare) source to a disability (glare, flash blindness) source (e.g. using the CW Lasers systems). When a modulator that includes a DOE is used, a pattern that shows the distribution in space of a couple of wavelengths is generated. $Beam_1$ also includes a reflective light valve (beam steering/raster system) that dynamically moves the light pattern in an oval motion 158.

Example 4

Figure 6:
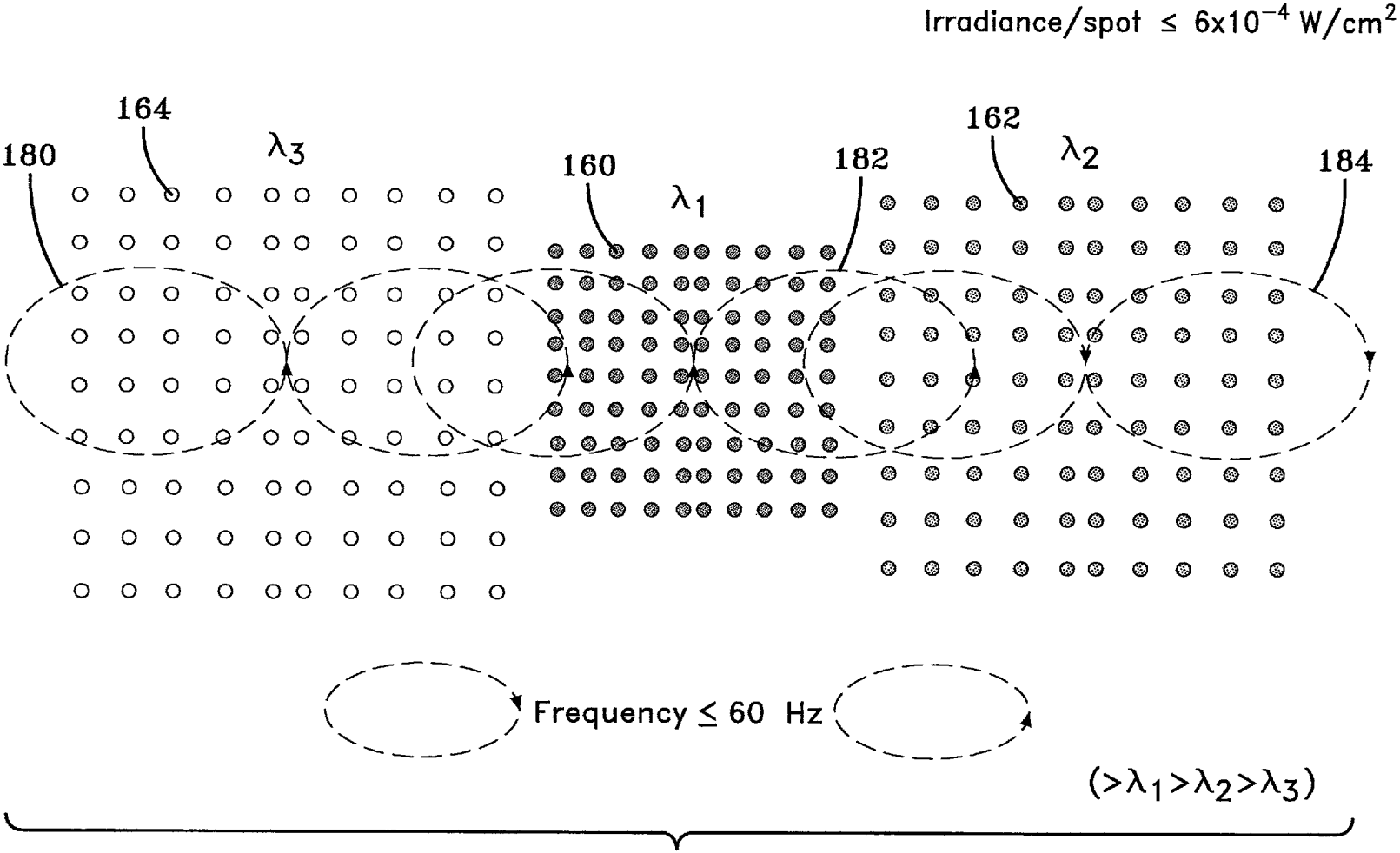
FIG. 6 is a schematic drawing of another example of different spatial array patterns for lights having different wavelengths.

Another example of the contemplated device produces a pattern shown in FIG. 6. This example includes:

$Beam_1$: CW monochromatic light source at $\lambda$1;

$Beam_{2,3}$: Double CW monochromatic light source at $\lambda_2$ and $\lambda_3$;

$Beam_4$: Broad band CW/pulsed visible light source;

Modulator: Diffractive Optical Element (DOE), Beam steering system of laser light at $\lambda_1<\lambda_2<\lambda_3$, and integrated optics.

In one example, $Beam_1$ has a blue emission (wavelength $\lambda_1$ 150) and $Beam_{2,3}$ has green (wavelengths $\lambda_2$152) and red emissions (wavelength $\lambda_3$154). Accordingly, $\lambda_1<\lambda_2<\lambda_3$. With the addition of a broad band CW/Pulsed light source, the system can transition from a dazzling (discomfort glare) source to a disability (glare, flash blindness) source (e.g. using the CW Lasers systems). The modulator, which includes the DOE, can produce patterns 160, 162, 164 (the patterns show the generated distribution in space of the three wavelengths $\lambda_1$, $\lambda_2$, $\lambda_3$). When the reflective light valve (beam steering/raster system) is added to the system, each pattern (160, 162, 164) can dynamically move the pattern in an eight-figure motion as seen in (180, 182, 184), respectively. Note that the patterns of motion 180, 182, 184 may be the same or different from each other.

The above description and examples are given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

The invention claimed is:

1. A visual impairment device comprising:

a power supply, an intense light source connected to said power supply, said light source comprising two or more beams of intense light having different peak wavelengths and a wavelength bandwidth less than 50 nm, a modulator for modulating the two or more beams of intense light to produce a spatial array such that at least one of the beams used to produce the spatial array has the requisite irradiance to cause visual impairment, wherein the spatial array covers an area with a pattern of light beams made by (a) splitting one or more said beams of intense light into a plurality of beams to produce a pattern of discrete beams separated by a preselected distance, or (b) moving one or more said beams of intense light across a space in a predetermined pattern, or a combination of (a) and (b); and a control circuit connected to said intense light source.

2. The device of claim 1, wherein the visual impairment is chosen from one of: startle, distraction, glare, flash blindness, afterimage, vertigo, disorientation, photophobia, headaches, or a combination thereof.

3. The device of claim 1, wherein each beam peak wavelength is separated from each other beam peak wavelength by more than one wavelength band width.

4. The device of claim 1, wherein one of the beams of intense light has a wavelength that is outside the visible range of 400-700 nm.

5. The device of claim 1, wherein the modulator uses a reflective light valve, or a refractive light valve, or a combination thereof for modulating the beam.

6. The device of claim 1, wherein the intense light source produces an LED light, a pulsed laser, a continuous wave laser, or a combination thereof.

7. The device of claim 1, wherein the at least two intense light beams are selected from:

an ultraviolet light having a peak wavelength range 310-400 nm, a blue light having a peak wavelength range 400-500 nm, a green light having a peak wavelength range of 500-580 nm, a red light having a peak wavelength range 580-700 nm, or an infrared light having a peak wavelength range 700-1500 nm.

8. The device of claim 1, wherein one or more of the beams of intense light is a laser beam.

9. The device of claim 1, wherein one or more of the beams of intense light is a light emitting diode (LED).

10. The device of claim 1, wherein the at least one beam with the requisite irradiance to cause visual impairment causes visual impairment within 250 msec (0.25 sec) of light exposure.

11. The device of claim 1, wherein one or more beams used to produce the spatial array are colinearly propagated.

12. The device of claim 1, wherein the device can be controlled manually, automatically, remotely or a combination thereof.

13. The device of claim 1, wherein the control circuit adjusts one or more parameters selected from:

a. divergence of the beams of intense light;

b. irradiance of the beams of intense light;

c. choice of wavelength for one or more of the beams of intense light;

d. size of the spatial array;

e. frequency of a dynamic spatial array f. pattern of the array g. frequency of modulation of a beam.

14. The device of claim 1, wherein the modulator comprises an element selected from: a multiplexer, a beam steerer (rasterring), a mirror, a prism, a diffraction grating beam splitter or a combination thereof.

15. A visual impairment device comprising:

a power supply;

a laser light source connected to said power supply and capable of producing two or more laser beams having different peak wavelengths, wherein at least one of said laser beams has a wavelength in the visible range of 400-700 nm;

a modulator for spatially modulating the two or more beams of intense light in a spatial array such that at least one of said beams in the array has the irradiance to cause visual impairment within 0.25 seconds of light exposure, wherein the spatial array covers an area with a pattern of light beams made by (a) splitting one or more said laser beams into a plurality of beams to produce a pattern of discrete beams separated by a preselected distance, or (b) moving one or more said laser beams across a space in a predetermined pattern, or a combination of (a) and (b); and a control circuit connected to said laser light source.

16. A method of using the device of claim 1 to cause visual impairment of a person who enters a visual impairment zone created by said device.

17. The method of claim 16, wherein the method comprises creating the visual impairment zone by covering an area with the spatial array of intense light such that at least one of the beams used to produce the spatial array has the requisite irradiance to cause visual impairment within 0.25 seconds of exposure to said beam.

18. The method of claim 16, wherein the visual impairment is a temporary visual impairment chosen from one of: visual discomfort, aversion, startle, distraction, glare, flash blindness, afterimage, photosensitivity, vertigo, disorientation, photophobia, headaches, muscle spasms, or a combination thereof.

19. A method of creating a visual impairment zone using device, the method comprising:

activating an intense light source comprising two or more beams of intense light having different peak wavelengths wherein at least one of the beams of intense light has a wavelength bandwidth less than 50 nm, modulating the two or more beams of intense light with a modulator to produce a spatial array such that at least one of the beams used to produce the spatial array has the requisite irradiance to cause temporary visual impairment, wherein the spatial array illuminates an area with a pattern of light beams made by (a) splitting one or more said beams of intense light into a plurality of beams to produce a pattern of discrete beams separated by a preselected distance, or (b) moving one or more said beams of intense light across a space in a predetermined pattern, or a combination of (a) and (b)

thereby creating said visual impairment zone.

20. The method of claim 19, wherein the intense light source produces an LED light, a pulsed laser, a continuous wave laser, or a combination thereof.

21. The method of claim 19, wherein the two or more laser beams have different peak wavelengths, wherein at least one of said laser beams has a wavelength in the visible range of 400-700 nm; the method further comprising spatially modulating the two or more beams of intense light in a spatial array such that at least one of said beams in the array has the irradiance to cause visual impairment within 0.25 seconds of light exposure.

* * * * *